United States Patent [19]

Tanis

[11] 3,953,707

[45] Apr. 27, 1976

[54] METHOD FOR PREHEATING AIRCOOLED, AIRCRAFT ENGINES

[76] Inventor: Peter G. Tanis, 1226 Highway 169 S., Fort Dodge, Iowa 50501

[22] Filed: Sept. 14, 1973

[21] Appl. No.: 397,372

[52] U.S. Cl. ..... 219/205; 123/122 F; 123/142.5 E; 184/104 A; 219/523

[51] Int. Cl.[2] ..... H05B 1/00; F02N 17/02; F01M 5/02

[58] Field of Search ..... 219/202 E, 205–208, 219/523, 316, 335, 336; 123/142.5 E, 142.5, 56 A, 56 AA, 56 AB, 196 AB, 122 F, 179 R, 184; 184/104 A, 104 R

[56] References Cited

UNITED STATES PATENTS

| | | | |
|---|---|---|---|
| 1,211,935 | 1/1917 | Groshans | 123/142.5 E |
| 1,332,970 | 3/1920 | Berres | 184/104 A |
| 1,377,352 | 5/1921 | Johnson | 219/206 X |
| 1,395,949 | 11/1921 | Eckman | 219/205 |
| 1,416,897 | 5/1922 | Simon | 219/336 X |
| 1,517,301 | 12/1924 | McMichael et al. | 219/205 X |
| 1,553,026 | 9/1925 | Brown | 219/205 |
| 1,784,541 | 12/1930 | Rouillard | 219/205 X |
| 1,794,891 | 3/1931 | Gerhardt | 219/205 |
| 1,805,040 | 5/1931 | Groves | 219/205 X |
| 1,817,850 | 8/1931 | Schwalbach | 219/316 X |
| 2,000,825 | 5/1935 | Davies | 219/205 UX |
| 2,311,146 | 2/1943 | Wiegman | 123/56 AA |
| 2,487,326 | 11/1949 | Freeman | 123/142.5 E X |
| 2,680,185 | 6/1954 | Basile | 219/205 |
| 2,834,864 | 5/1958 | Grinde | 219/208 X |
| 3,213,263 | 10/1965 | Steenbergen | 219/205 |

FOREIGN PATENTS OR APPLICATIONS

| | | | |
|---|---|---|---|
| 453,753 | 9/1936 | United Kingdom | 219/205 |
| 114,124 | 3/1918 | United Kingdom | 123/142.5 |

*Primary Examiner*—A. Bartis

[57] ABSTRACT

An aircooled aircraft engine is preheated prior to starting by the insertion of electric heating devices into the blind holes, normally provided for the reception of thermocouples, in the metal castings of the cylinder heads immediately adjacent to the spark plugs. The heating devices are of such size and shape that the heating devices are entirely confined in the metal wall of the cylinder casting so that when energized substantially all the heat is transferred to the castings immediately adjacent the spark plug. The heating devices are energized for a sufficient time prior to starting to generate enough heat to prevent frosting of the spark plug, prevent condensation and improve vaporization of fuel when starting the engine. Additional electric heating devices may be inserted into drain hole of the oil sump and/or the oil suction screen in the sump for simultaneous energization with the heating devices in the cylinder heads whereby heat is supplied to the engine oil to facilitate proper lubrication of the cylinders when starting the engine.

5 Claims, 9 Drawing Figures

FIG. 1
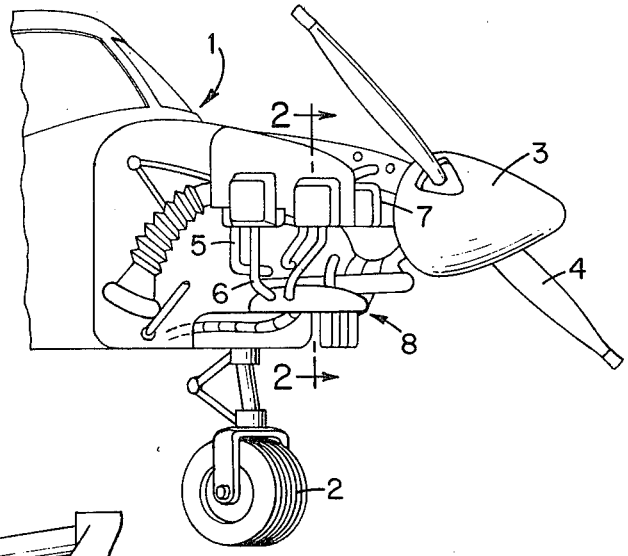
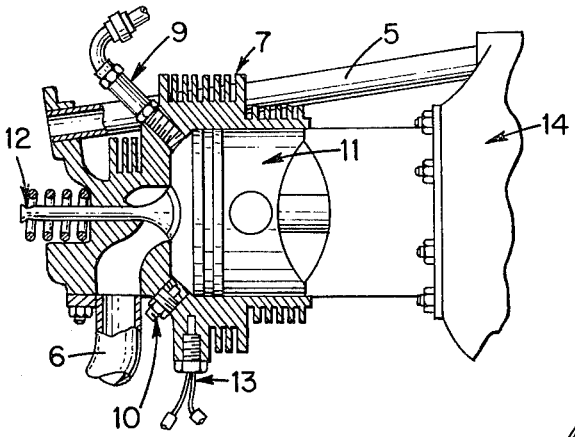
FIG. 2
FIG. 3
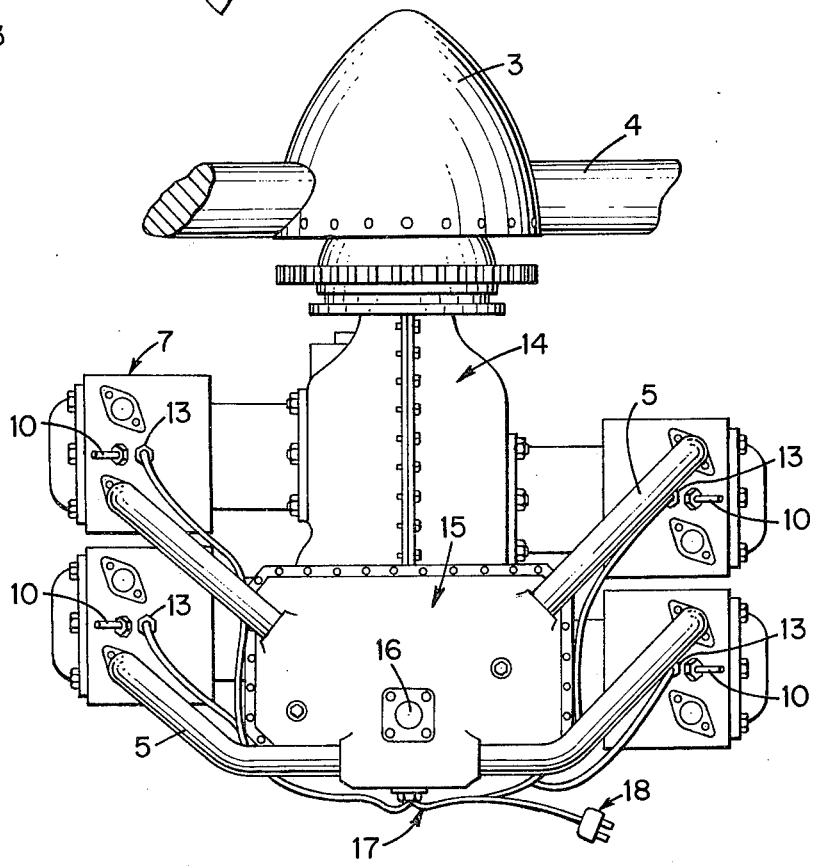

METHOD FOR PREHEATING AIRCOOLED, AIRCRAFT ENGINES

This invention relates to the preheating of aircooled, aircraft engines and has to do particularly with the preheating of piston type, aircraft engines to facilitate starting at low temperatures and to prevent damage to the internal parts of the engine resulting from improper lubrication immediately after starting.

Most aircraft engines are difficult to start at temperatures below about 10° F., and ordinarily if started at such temperatures damage often occurs due to failure of proper lubrication of internal parts thereof, such as the cylinder walls and piston rings. Consequently, prior to starting, it is customary in cold weather to provide some source of heat for the purpose of applying ambient or radiant heat to the surface of the engine.

Heretofore, various systems have been proposed or used for preheating aircraft engines prior to starting. One type of system involves the transfer of heat to the engine by moving warm air through the engine compartment. For example, portable combustion heaters which move air into the engine cowling have been used. A crude type of system consists of a blow torch aimed into a section of stove pipe placed in the cowling. Portable electric heaters with fans have been placed in the cowling and the engine covered with a blanket. Another system comprises a can containing charcoal fire to hang on the propeller and ducts for transferring warm air from the can to the engine cowling. Also, attempts have been made to preheat engines by directing a common radiant heater or a sunlamp thereon.

The prior preheating systems have serious disadvantages. Often such systems produce only sufficient heat to warm the cylinders and not the oiling mechanism. Consequently, there is frequent and various degrees of damage after the engine is started. Also, many of the systems expose the aircraft to undue fire hazards. Furthermore, such systems are often inconvenient, are not portable or are not an integral part of the engine whereby they may accompany the aircraft.

An object of the present invention is to provide a preheating system which overcomes the disadvantages inherent in the prior art devices.

Another object of the invention is to provide a preheating system which will apply heat directly to the part of the engine which needs heat to facilitate starting thereof.

Also an object of the invention is to devise a preheating system which an be operated for long periods of time without overheating the engine or creating a fire hazard.

Another object of the invention is to provide means for preheating internal parts of the engine to prevent damage due to lubrication difficulties soon after starting the engine.

Still another object of the invention is to improve fuel vaporization in the engine fuel intake system during the starting operation at low temperatures.

A further object of the invention is to prevent condensation inside the engine during preheating thereof.

Another object is to prevent spark plug frosting during the starting of the engine at low temperatures.

Another object is to provide means for reducing difficulty in cranking the engine due to congealed oil on the cylinder walls and under the piston rings at low temperatures.

The objects and advantages of the invention will become more apparent from the following description and from the accompanying drawings which describe and illustrate in detail certain modifications of the invention.

In accordance with the invention, heat is applied to the parts needed to be preheated by conduction as opposed to transfer of heat by convection or radiation as practiced heretofore. The heating device is placed in direct contact with the part to be preheated and the heat conducted to such part or parts. According to one aspect of the invention, a resistance type of heating element is installed in the cylinder head of the engine preferably adjacent to the spark plug. The heat conducted to the cylinder head facilitates starting of the engine by inducing improved fuel vaporization and preventing spark plug frosting. Frosting of the spark plugs will occur if the engine does not start on the initial ignition due to the sudden rise and fall of the temperature of the spark plug area.

According to another aspect of the invention, oil sump heaters are used to assure proper lubrication of the engine during the initial start up period and to assure fuel vaporization in the intake system. One type of installation which has been found to be satisfactory for four cylinder engines is to place the heater in the oil pump suction screen. For six cylinder engines, it is preferable to install an additional heater in the oil sump area, for example, by placing the heater in the oil sump drain plug opening.

A feature of the invention is the construction of the heating devices. The cylinder head heater is adapted for use in most currently manufactured aircraft engines. With the exception of a few models, the engines of most aircraft are provided with holes in each cylinder head for receiving a bayonet type thermocouple. The heating device of the present invention is intentionally constructed to fit in the thermocouple holes which are normally not supplied with thermocouples for more than one cylinder head. If it is desired or necessary to install a heater in the head containing the thermocouple, the thermocouple may be removed or, if desired, left in and an additional hole drilled in the head for the heater, or the heater may be omitted from the cylinder head containing the thermocouple, or a washer type heater (FIG. 9) may be used in connection with the lower spark plug. Also, in those models of engines not provided with thermocouple holes, suitable holes may be drilled in the cylinder head for the installation of heaters.

The oil sump heaters are different for each model of engine, but generally are similar to construction to the cylinder head heaters. The body of the oil sum heaters are screwed into the sump drain plug housing or into the sump pump suction screen housing.

Referring to the drawings:

FIG. 1 is a side view of the front quarter of an aircraft with a part of the cowling removed to expose the engine.

FIG. 2 is a fragmentary view, partly in section, the plane of which is indicated by the line 2-2 of FIG. 1, showing a cylinder head in accordance with the invention.

FIG. 3 is a bottom view of the engine of a four cylinder model aircraft showing the location of vaious components of the heating system.

Figure 4:
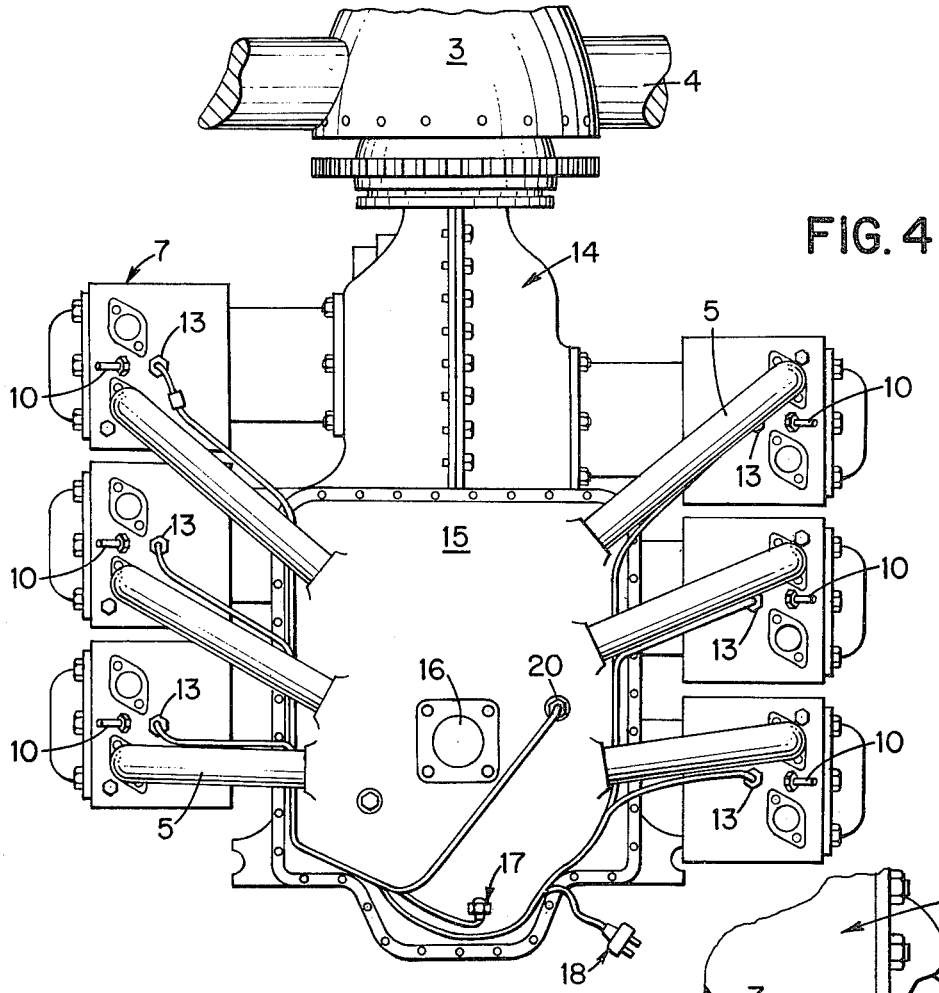
FIG. 4 is a bottom view of an aircraft engine showing the location of the components of the heater for a six cylinder model.

Referring to FIG. 1, an aircraft 1 is shown supported on a nose wheel assembly 2 and equipped with a propeller spinner 3 and blades 4. Intake pipes 5 and exhaust pipes 6 are connected to aluminum cylinder heads 7, two of which are shown on the right side of the engine. The pipes 6 discharge into an exhaust system or muffler 8.

In the fragmentary view in FIG. 2, the portion in section shows upper and lower spark plugs 9 and 10, piston 11 and exhaust valve 12. The cylinder head heater 13, the detail construction of which will be described hereinafter, is located near the lower spark plug 10 permitting a direct heat path to the plug to prevent frosting mentioned heretofore. A portion of the crank case, shown more fully in FIGS. 3 and 4, is indicated by the numeral 14.

The location of the heaters for a four cylinder engine, according to one modification of the invention, is illustrated in FIG. 3. The oil sump casing 15 is equipped with a carburetor mount pad 16 and engine intake pipes 5 referred to heretofore. The oil pump suction screen heater is designated generally by the numeral 17 for purposes of location, the details of construction being more fully shown in FIG. 8. The electrical leads from the cylinder head heaters and the suction screen heater are connected to the power plug 18.

The modification of the invention as applied to a six cylinder engine is shown in FIG. 4. This modification differs from that of the four cylinder model essentially in the addition of the oil sump heater 20. The oil sump casing is normally equipped with an oil drain plug which according to the present invention is replaced with the heater 20, the details of construction and installation thereof being shown in FIGS. 5 and 7.

The sectional view of the rear end of the engine (FIG. 5) shows details of the installation of the oil sump and the oil pumpsuction screen heaters 20 and 17 and the oil pump mechanism associated therewith. The latter mechanism comprises an oil pump 22 connected to the suction screen 23 and the pressure screen 24 by channels 25 and 26.

Figure 6:
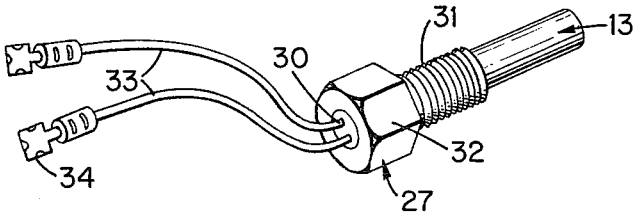
FIG. 6 is a perspective view of the cylinder head heater.
Figure 7:
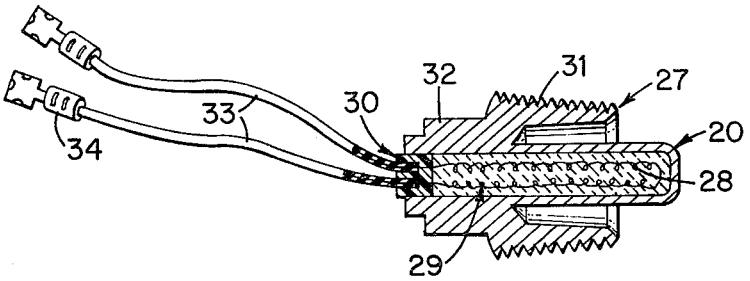
FIG. 7 is a side view, partly in section, of the oil sump heater.
Figure 8:
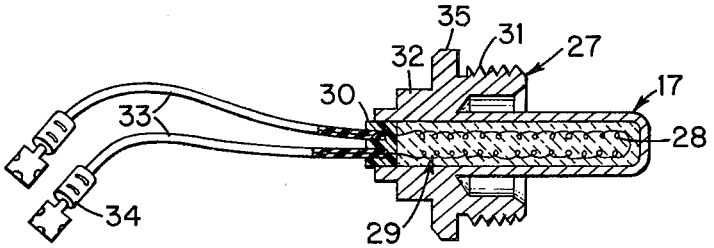
FIG. 8 is a side view, partly in section, of the oil pump suction screen heater.

As shown in FIGS. 6, 7 and 8, the preferred cylinder head heater 13, oil pump suction screen heater 17 and oil sump heater 20 comprise a threaded, cylindrical body 27 containing heating element 28 insulated from the body by ceramic material 29. The body is preferably made of brass and the heating element of nichrome wire although the invention is not limited to such materials. The heating element 28 is enclosed in the body 27 and is held in place by a plastic sealant 30 in the end of the body which contains the threads 31 and the enlarged hexagonal wrench fitting 32. The nichrome heating element 28 is attached to conventional power leads 33 and electrical connections 34 one end of each power lead being secured also in the sealant.

The suction screen heater 17 (FIG. 8) is similar in construction to the cylinder head heater 13 (FIG. 6) with exception that the threaded portion is in the form of a sleeve around the cylindrical portion instead of threads cut directly on the stem of the heater. The sleeve portion containing the threads 31 is inserted into the suction screen 23 (FIG. 5) which is supported on the sleeve, the free end of the cylindrical body portion extending into direct contact with the oil in the sump and heating the same. It will be observed that the threaded portion 31 is provided at the back end wih a jam or stop 35, both the threaded portion and the jam being slightly larger in diameter than the hexagonal fitting 32.

Figure 5:
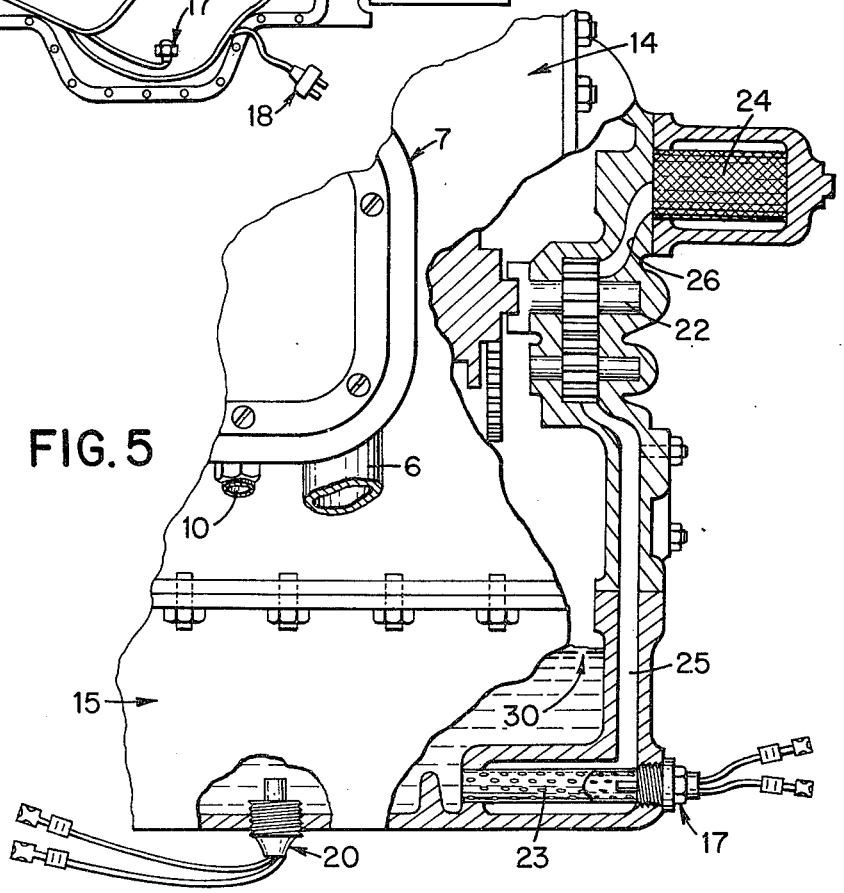
FIG. 5 is a fragmentary, vertical rear end view of an engine with parts of the crank case and sump broken away to show the details and location of the oil sump heater and the suction pump screen heater as installed in the engine.

The heater 20 (FIG. 7) for the oil sump differs from the suction screen heater 17 (FIG. 8) in the size and shape of the sleeve. Also, the threaded portion is slightly increased in length and has no jam or stop. The construction permits the heater to be screwed into the oil sump drain plug opening as shown in FIG. 5.

Figure 9:
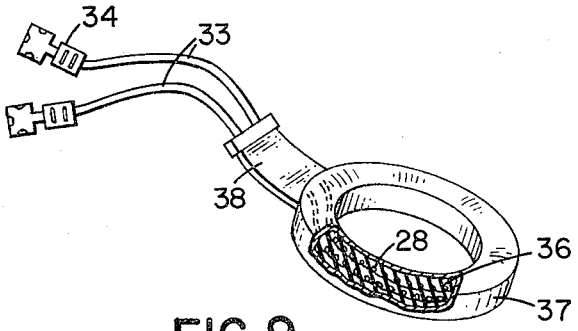
FIG. 9 is a perspective view, partly in section, of a spark plug washer type of cylinder heater.

An alternative type of cylinder head heater is shown in FIG. 9. Instead of the previously described heater 13 which is installed in the thermocouple hole, the heater of FIG. 9 is used as a spark plug washer. The heating element 28 is embedded in an insulation material 36, such as asbestos, mica or glass wool. The heating element is enclosed in a copper ring 37 which is normally rigid enough to hold its shape but sufficiently pliable so that it conforms air tight to the contour of the cylinder head when placed on the electrode end of the spark plug and the plug screwed in place. It is preferable to provide a support 38 for the power leads 33. The support may be of various forms of which a copper strip or a cut away tube has been found to be satisfactory.

For purposes of illustration and not as limitation, the following is an example of a cylinder head heater which has been used. The body, aproximately 1¾ inch long with a hexagonal fitting on one end 7/16 inch long and ½ inch across the hexagonal, is machined from brass. The remaining length of the body is turned to a diameter of 0.320 inch with ⅜24 threads on approximately 17/32 inch adjoining the hexagonal fitting. Starting with the hexagonal end, the body is bored out with a 17/64 drill to a depth of about 1⅝ inch. The nichrome heating element is attached to the lead wires with crimped on connectors and the wires covered with vinyl tubing. A suitable tubing material is polyvinyl chloride capable of withstanding temperatures of 85° C. or polytetraflourethylene capable of resisting temperatures up to about 250° C. The heating element is inserted in the body and sealed in place with a plastic sealant capable of withstanding temperatures in excess of 400° F. A heat setting polyester resin made from polymethacrylate may be used as the sealant. The leads are connected to a 115 volt A C electric power for about 20 seconds until the temperature rises enough to set the plastic, and then the plastic allowed to cure for about 4 hours before using the heater.

In practicing the invention, a cylinder head heater is threaded in to the holes provided in the head for thermocouples. The lead wires are routed around and along the intake pipes, the lower ignition harness and the oil filler tube. The power plug on the lead wires should be accessable through the oil filler door in the cowl. The oil is drained from the engine, the plug which covers the oil pump suction screen removed and the oil screen heater installed. In six cylinder models, the oil sump drain plug is also replaced by a sump heater. The oil is then replaced in the crank case. When the power line is attached to the plug in the cowl, the cylinder heads should begin to feel warm in about 30 minutes and the area of the sump near the heater should also begin to feel warm.

The heaters should be operated for several hours before attempting to start the engine, or they may be left on continuously when the aircraft is not in use. It is preferable to place a cover over the engine when using the heaters, especially at low temperatures. The heaters do not become as hot in the engine as they do when used in air due to the dissipation of heat by the cylinder. The heaters have been operated at 70° F. outside temperature without the hottest part of the engine head exceeding about 180° F. On a four cylinder model, at an outside air temperature of −15° the oil temperature was maintained at +35° F. and the crank case at 43° F. On a six cylinder model, a crank case temperature of 90° F. and an oil sump temperature of 92° F. were maintained when the outside air temperature was 32° F. Upon starting the engine with the preheater on, the oil pressure indicator responded more rapidly than such indicator in an engine started at 70° F. without a preheater.

When leaving the heater on continuously and the engine not operating, the temperature of the sump oil or the cylinder head can be controlled by a thermostat for automatically regulating the amount of power input to the heater, but such control means are usually not necessary.

The cylinder head and the oil sump casing are usually cast from aluminum. As used in the claims, the term "casting" is intended to mean the cylinder head and the oil sump casting.

The embodiment of the invention shown in the drawings is for purposes of illustration. Many variations may be made in the details of construction without departing from the spirit of the invention, and such variations and modifications are considered as coming within the scope of the invention.

I claim:

1. The method of preheating an aircooled, aircraft engine prior to starting the engine, said engine having a cylinder head casting, a spark plug in the casting of the cylinder head and a blind hole formed entirely in the metal of said casting immediately adjacent the spark plug, which comprises inserting in said blind hole an electric heating device of construction, size and shape such that the device is substantially entirely confined in the metal wall of the casting, applying an electric current to said heating device to generate heat therein whereby substantially all the heat is transferred to the casting to heat the casting immediately adjacent the spark plug, and maintaining the current for sufficient time to generate enough heat in the casting to prevent frosting of the spark plug and to prevent condensation and to improve vaporization of fuel when starting the engine.

2. The method as described in claim 1 in which the heating device is installed in a hole normally provided in the cylinder head casting for holding a thermocouple.

3. The method of preheating an aircooled, aircraft engine prior to starting the engine, said engine having cylinder head castings, spark plugs in the castings, a blind hole formed entirely in the metal of the castings immediately adjacent to each of the spark plugs required to be heated, an oil sump casing, holes in the casing for receiving a drain plug and an oil suction screen, which comprises inserting in each of said blind holes immediately adjacent the spark plugs an electric heating device of construction, size and shape such that the heating device is confined substantially entirely in the walls of the casting, applying an electric current to said heating devices to generate heat therein whereby substantially all the heat is transferred to the castings to heat the castings immediately adjacent the spark plugs, and in addition inserting a heating device containing an electric heating element in at least one of said holes in the oil sump casing which are normally provided for said drain plug and oil suction screen, the contruction, size and shape of the latter heating device being such that a portion thereof containing the electric heating element is in contact with the wall of the oil sump casing and another portion extends into the interior of the casing occupied by the oil, applying simultaneously an electric current to the latter device whereby a substantial portion of the heat from the device is transferred directly to the casing and a portion to the oil in the sump, and maintaining the electric current to the heating device in the cylinder head and in the oil sump for sufficient time to prevent frosting of the spark plugs and to prevent improper lubrication of the cylinders when starting the engine.

4. The method as described in claim 3 in which the heating device in the oil sump casing is inserted in the hole normally provided for an oil suction screen.

5. The method as described in claim 3 in which the heating device in the oil sump casing is inserted in the hole normally provided for said drain plug.

* * * * *